US011317720B2

(12) United States Patent
Habing

(10) Patent No.: US 11,317,720 B2
(45) Date of Patent: May 3, 2022

(54) ADJUSTABLE LOUNGE GARDEN SWING

(71) Applicant: Dream Visions, LLC, Tustin, CA (US)

(72) Inventor: Theodore Gerard Habing, Tustin, CA (US)

(73) Assignee: HABLAMER, LLC, Green Cove Springs, FL (US)

( * ) Notice: Subject to any disclaimer, the term of this patent is extended or adjusted under 35 U.S.C. 154(b) by 0 days.

(21) Appl. No.: 16/870,789

(22) Filed: May 8, 2020

(65) Prior Publication Data

US 2020/0268156 A1 Aug. 27, 2020

Related U.S. Application Data

(63) Continuation of application No. 14/566,600, filed on Dec. 10, 2014, now Pat. No. 10,667,610.

(60) Provisional application No. 61/912,499, filed on Dec. 5, 2013.

(51) Int. Cl.

| | |
|---|---|
| ***A63G 9/02*** | (2006.01) |
| ***A47C 1/14*** | (2006.01) |
| ***A47C 3/025*** | (2006.01) |
| ***A63G 9/00*** | (2006.01) |

(52) U.S. Cl.

CPC ..... *A47C 3/0255* (2013.01); *A47C 1/14* (2013.01); *A63G 9/00* (2013.01); *A63G 9/02* (2013.01)

(58) Field of Classification Search

CPC ... A63G 9/00; A63G 9/02; A63G 9/12; A47C 3/0255; A47C 1/14

USPC ..... 472/118, 125

See application file for complete search history.

(56) References Cited

U.S. PATENT DOCUMENTS

| | | | |
|---|---|---|---|
| 446,659 | A | 2/1891 | Bunker |
| 531,472 | A | 12/1894 | Shorey et al. |
| 725,396 | A | 4/1903 | Bausman |
| 862,686 | A | 8/1907 | Wallace |
| 2,480,300 | A | 8/1949 | Luketa |
| 2,710,650 | A | 6/1955 | Sowder |
| 3,235,304 | A | 2/1966 | Glass |
| 3,295,885 | A | 1/1967 | Barksdale |
| 3,528,657 | A | 9/1970 | Krupsky |
| D230,921 | S | 3/1974 | Bonnnell et al. |
| 3,825,299 | A | 7/1974 | Gaucher |
| 3,934,932 | A | 1/1976 | Ekornes |
| 4,240,625 | A | 12/1980 | Meeker |
| 4,364,603 | A | 12/1982 | Johnson |
| 4,674,797 | A | 6/1987 | Tateyama |
| 4,678,232 | A | 7/1987 | Ishida et al. |
| 4,790,599 | A | 12/1988 | Goldman |

(Continued)

*Primary Examiner* — Kien T Nguyen

(74) *Attorney, Agent, or Firm* — Womble Bond Dickinson (US) LLP

(57) ABSTRACT

The present invention is an adjustable lounge garden swing having a fixed support structure and a seat support pivotally suspended from the support structure on a single pivot axis to provide a pendular movement when in motion. At least one lounge seat is pivotally coupled to the support structure where the lounge seat has a seating portion and a backrest portion that are fixed relative to one another but adjustable relative to the seat support to adjust the reclination angle of lounge seat. In particular, an embodiment of the present invention provides a lounge seat for a garden swing that has an adjustable reclination angle relative to the seat support and is positionable at a selected reclination angle through a reclination adjustor.

26 Claims, 6 Drawing Sheets

(56) References Cited

U.S. PATENT DOCUMENTS

| | | | | |
|---|---|---|---|---|
| 5,154,672 | A | 10/1992 | Brown | |
| D364,282 | S | 11/1995 | Andersson | |
| 5,588,702 | A | 12/1996 | Litwin | |
| 5,642,918 | A | 7/1997 | Sakamoto et al. | |
| 5,803,817 | A | 9/1998 | Stern | |
| 5,803,818 | A | 9/1998 | Tseng | |
| 5,902,187 | A | 5/1999 | Boring | |
| 6,001,021 | A | 12/1999 | Battaglia | |
| 6,027,409 | A | 2/2000 | Favorito et al. | |
| 6,045,181 | A | 4/2000 | Ikeda et al. | |
| 6,348,005 | B1 | 2/2002 | Tseng | |
| 6,368,261 | B1 | 4/2002 | Doehler | |
| 6,547,328 | B2 | 4/2003 | Liu | |
| 6,585,319 | B2 | 7/2003 | Tseng | |
| 6,655,053 | B1 | 12/2003 | Weed | |
| 6,802,783 | B1 | 10/2004 | Tseng | |
| 6,827,650 | B1 | 12/2004 | Tseng | |
| 6,902,238 | B1 | 6/2005 | Abt et al. | |
| 6,949,027 | B1 | 9/2005 | Habing et al. | |
| 6,994,631 | B1 | 2/2006 | Habing | |
| D522,259 | S | 6/2006 | Wu | |
| D531,826 | S | 11/2006 | Nutsos | |
| D548,472 | S | 8/2007 | Habing et al. | |
| 7,311,359 | B2 | 12/2007 | Smith | |
| 7,892,101 | B1 * | 2/2011 | Weisz | A47D 13/105 472/118 |
| 7,997,644 | B2 | 8/2011 | Hoffman et al. | |
| 8,123,288 | B2 | 2/2012 | Murphy et al. | |
| 2006/0003849 | A1 | 1/2006 | Habing | |
| 2006/0270480 | A1 * | 11/2006 | Chen | A47D 13/105 472/118 |
| 2009/0036225 | A1 * | 2/2009 | Tseng | A47C 3/0255 472/125 |
| 2013/0005493 | A1 * | 1/2013 | Kim | A47C 3/0255 472/118 |
| 2013/0288811 | A1 | 10/2013 | Huntsberger et al. | |

* cited by examiner

ADJUSTABLE LOUNGE GARDEN SWING

CROSS-REFERENCE TO RELATED APPLICATIONS

This application is a continuation of U.S. application Ser. No. 14/566,600, filed Dec. 10, 2014, which claims the benefit of U.S. Provisional Application No. 61/912,499, filed Dec. 5, 2013, the disclosures of which are incorporated herein by reference.

FIELD OF THE INVENTION

The present invention relates to outdoor furniture and more particularly to an adjustable garden swing having a pendular movement when in motion.

BACKGROUND

Garden swings and reclining lounge chairs are popular backyard, garden and pool accessories for sitting, relaxing and outdoor entertaining. Numerous designs have been introduced over the years that are comfortable and designed for therapeutic comfort. Various reclining lounge chairs or complicated articulated structures provide a fixed sitting structure, but lack the therapeutic comfort of a reclining lounge chair. Yet only simple, static chairs or lounges have been introduced hanging from a support to provide a simple swing. Structures that provide soothing pendular movements when in motion are lacking and no adjustable lounge garden swing with a lounge seat designed with therapeutic comfort have been introduced.

There are numerous chairs including reclining, zero gravity and other therapeutically designed chairs in the marketplace. Some are designed capable of gliding and some capable of rocking motions, many of them are chair designs originating decades ago.

One early such chair sought comfort where an occupant could sit with feet raised above the ground with the ability to adjust the tilting or angular position of the chair and select the angle at which the chair reclines. The chair used a rack and pinion type adjustment means or a sprocket and sliding pin type adjustment means as identified in U.S. Pat. No. 3,235,304. However, such a chair continues to lack any swinging capability.

Improved styles provided better means of adjusting the angle at which the chair reclines by providing, for example, a frictional coupling means for use in adjusting the relative angular position of the seat and the back relative to each other. Such a chair is described in U.S. Pat. No. 3,934,932. However, the improved adjustment mechanism lacks integration of a reclining chair with a garden swing.

Later, more elaborate designs provided further improvements to adjustment mechanisms and improved adjustments between the seat portion and backrest portion. Such chair designs are discussed in U.S. Pat. No. 6,902,238, however, complex chairs of this kind are far removed from the challenging garden setting and impractical for the garden swing application.

Further designs added a gliding motion with the reclining feature such as in U.S. Pat. No. 7,997,644, but continued to lack application in the complex garden setting or to provide an appealing swing motion for the occupant much less the comfort of a therapeutically designed lounge seat.

Further designs added a rocking motion to the reclining feature such as in U.S. Pat. No. 8,123,288. At the time, chairs were capable of providing a controlled rocking motion only when in the upright position. Many chairs included some type of safety feature such as an extendable foot that prevented rocking when the chair is in a reclined position. This new design provided a means of a rocking motion even when the chair was in a reclined position. However, these chairs continued to lack the same desired features of designed for therapeutic comfort in a garden swing.

Zero gravity chairs evolved for increased comfort and relaxation in a lounge seat. Zero gravity chairs are generally designed with a rigid therapeutically designed shape to hold an occupant in a position where the angle between the legs and the torso may be greater than 90 degrees. The term zero gravity positioning relates to the orientation of the legs above the level of the heart when in a substantially horizontal position. Typically, zero gravity chairs are designed such that the legs may be elevated such that the legs are even with or above a users heart. Zero gravity chairs may optionally enable the user to adjust the backrest portion to pivot relative to the seat portion allowing the user to adjust an angle between the seat portion and the backrest portion. These chairs are further optionally designed to enable both the backrest portion and the seat portion to pivot as a unit independent of the angle adjustment and for the entire chair to rotate on a base. An example of such a chair is described in U.S. Pat. No. 7,311,359.

Attempts to take any of these concepts to the outdoor garden setting have been limited. Early concepts created basic chain swings that incorporated a seating area with a planting area such as in U.S. Pat. No. 6,655,083.

More recent designs provide more elegant benches seats that are rigid and fixed, and swings on a stable structure to provide a pendular motion. Such a chair is identified in U.S. Pat. No. 6,994,631.

Improvements upon this concept provide more comfortable chairs with extendable foot rests and headrests. Such a chair is identified in U.S. Pat. No. 6,949,027.

However, even the recent garden swing designs provide fixed seats for sitting, but lack the ability to adjust into a reclining or near zero antigravity position for lounging that are capable of a pendular motion in the garden setting. What remains lacking are therapeutically designed lounge seats that are capable of reclining relative to the pendular structure with means of adjusting the reclination angle of the lounge seat.

Accordingly, there remains a need for a comfortable and therapeutically designed reclining lounge seat with a soothing pendular movement when in motion. The present invention solves many of these issues by providing an adjustable lounge garden swing having a soothing pendular movement when in motion.

SUMMARY

Embodiments of the present invention provide an adjustable lounge garden swing having a pendular movement. More particularly, embodiments of the present invention rely upon a therapeutically designed lounge seat attached to a seat support by a reclination adjustor that is pivotally suspended from a support structure.

The present invention is a therapeutically designed lounge seat with a reclination adjustor capable of varying the reclination angle of the lounge seat relative to the seat support as desired by an occupant. The therapeutically designed lounge seat includes a seat portion, a backrest portion, a headrest portion and a leg rest portion.

The support structure is engineered to safely and pivotally suspend one or more lounge seats and allow for a stable pendular movement when in motion. The design is to further provide options for the angle of reclination within the limits of the ground and structure to avoid the lounge reclining to an angle that may allow the headrest portion or leg rest portion of the lounge swing to contact the ground when swinging.

The seat support of the present invention is a structural frame member pivotally supported above the ground by the support structure. The seat support is pivotally suspended on a single pivot axis at the upper portion of the seat support designed so as to provide pendular movement when in motion.

The adjustable lounge garden swing of the present invention provides at least one lounge seat, but may provide two or more lounge seats as may be adequately supported by the support structure. When two lounge seats are suspended, both may be forward facing or alternatively, adjusted such that one is forward facing and the other is rear facing. The lounge seat and support may be pivoted to face in the opposite direction by means of an optional rotatable pivot assembly.

The lounge seat is pivotally coupled to the seat support by an axial joint that allows an axial motion about a center axis. Around the axial joint, the reclination angle can adjust from a more vertical forward, or positive, angle through a more horizontal position and then to a more vertical rear, or negative, angle for a diverse lounging experience.

The reclination angle between the lounge seat and the seat support is varied by an occupant through a reclination adjustor. The lounge seat is preferably releasably locked into place by a releasable locking pin on a reclination adjustor. The releasable locking pin is preferably a spring-loaded releasable locking pin affixed to the seat support that penetrates an adjustor disc affixed to the lounge seat in order to set the lounge seat reclination angle.

The reclination adjustor is preferably coupled between the seating portion of the lounge seat and the seat support, however, to accommodate various reclination options for the lounge seat, the reclination adjustor may attach to more than one portion of the lounge seat such as the seat portion and the backrest portion.

In conjunction with the reclination adjustor the present invention may further include a hydraulic device, electric device or other means of automated adjustment of the lounge seat reclination angle.

In any application incorporating an automated adjustment of the lounge seat reclination angle, it is preferred that a reclination adjustor securely lock and mechanically and releasably maintain the selected lounge seat reclination angle. This can be a device similar in function to the reclination adjustor or other such mechanical locking mechanism.

In a further embodiment of the present invention, the backrest portion of the seat may be pivotally coupled to the seating portion of the lounge seat so as to be positionable at a selected angle of recline relative to the seating portion of the lounge seat.

A preferred embodiment of the adjustable lounge garden swing of the present invention uses as support structure and at least one seat support pivotally suspended from the support structure on a single transverse pivot axis. At least one rigid lounge seat is pivotally coupled to a lower portion of the at least one seat support and a reclination adjustor is coupled between the lounge seat and the seat support.

A further preferred embodiment of an adjustable lounge garden swing of the present invention includes a support structure having at least one seat support with an upper portion and a lower portion. The upper portion of the at least one seat support is pivotally suspended from the support structure by at least one pivot assembly and the lounge seat is pivotally coupled to the lower portion of the one seat support by an axial joint about a central axis. A reclination adjustor is then coupled between the lounge seat and the seat support.

A further embodiment of an adjustable lounge garden swing of the present invention includes a support structure and at least one seat support having an upper portion, a central portion and a lower portion. The at least one seat support is pivotally suspended by its top portion from the support structure on a single transverse pivot axis. A lounge seat is attached to the lower portion of the seat support. The central portion of the seat support and the lower portion of the seat support are pivotally coupled by a reclination adjustor.

These and other aspects of the invention will be better understood from a reading of the following detailed description together with the drawings.

DETAILED DESCRIPTION

The present invention is an adjustable lounge garden swing having a pendular movement when in motion. Embodiments of the present invention uniquely combine a therapeutically designed lounge seat coupled to a seat support by a reclination adjustor that is pivotally suspended from a support structure.

In accordance with the present invention, apparatus and methods for comfortably positioning a person in a lounge seat are presented. A therapeutically designed lounge seat is disclosed that generally holds an occupant in a position where the angle between the legs and the torso may be greater than 90 degrees and the horizontal axis of the lounge seat is adjustable from about plus 30° to about minus 30° and more preferably from about plus 20° to about minus 30° and provides a soothing pendular motion. Typically, when the lounge seat is reclined in horizontal position to a minus position, the legs are elevated such that the legs are even with or above the occupant's heart. The disclosed lounge seat may optionally provide the occupant with the ability to vary the angle between a seat portion and the backrest portion of the lounge seat and to rotate the lounge seat as a unit about the horizontal axis while capable of providing a soothing pendular movement when in motion through a support structure.

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1A:
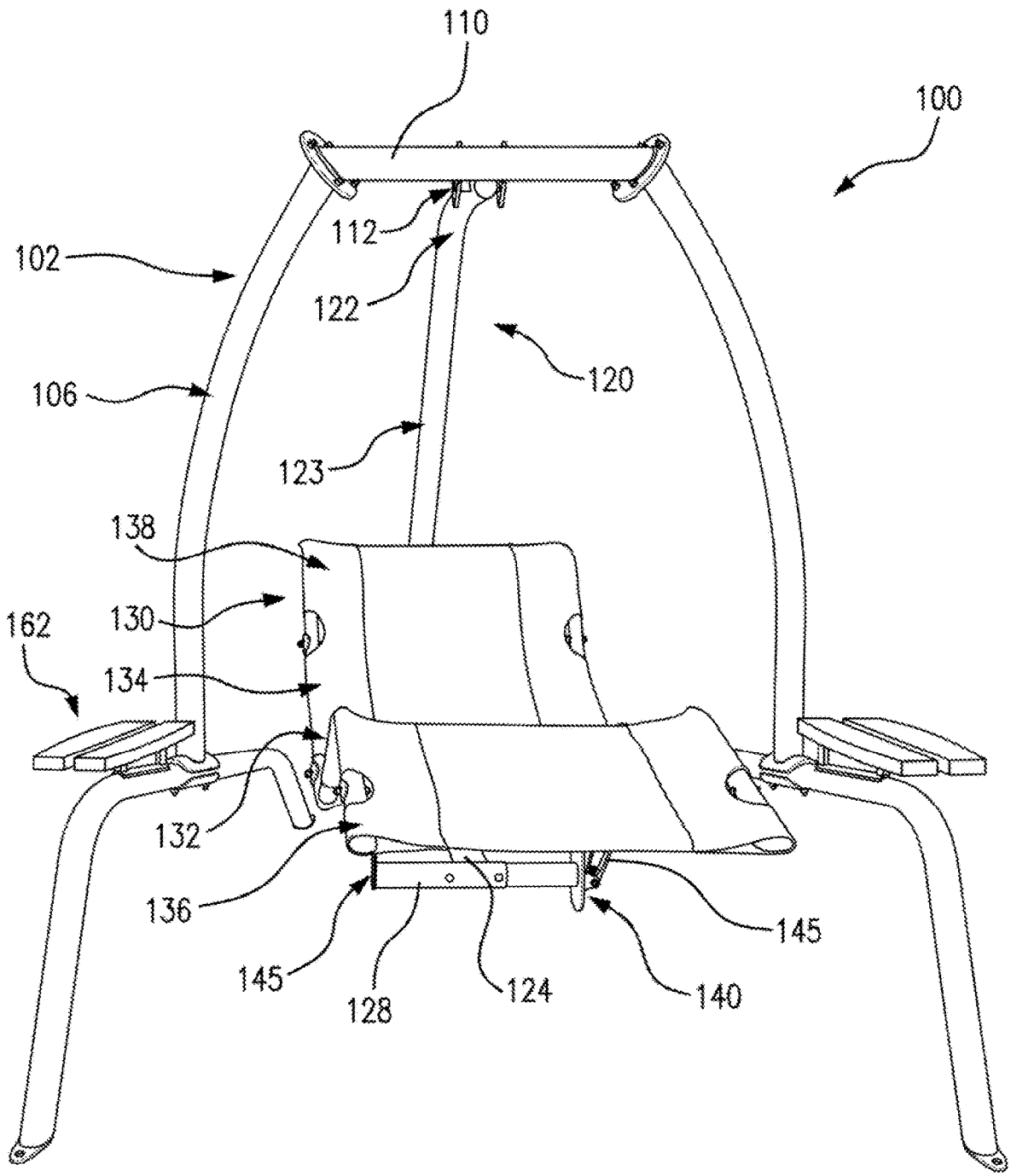
FIG. 1A is a front view of an embodiment of the single occupant swing constructed in accordance with the present invention illustrating a single lounge seat pivotally suspended by a single seat support.

FIG. 1A illustrates an embodiment of the present invention for a one person adjustable lounge garden swing 100 constructed in accordance with the present invention. Swing 100 has a fixed support structure 102 with generally upright members 106, and generally horizontal top member 110. Pivot assembly 112 is attached to top member 110. The upper ends of upright members 106 and the ends of top member 110 have cooperating flanges that are secured to one another with bolts or similar mechanical fasteners. This embodiment provides for a single seat support 120 of lounge seat 100. Seat support 120 fixedly attaches to forward cross bar 128.

Lounge seat 130 comprises seating portion 132 and backrest portion 134. Lounge seat 130 further comprises a leg rest portion 136 extending forward of seat portion 132 and a head rest portion 138 attached to the back rest portion 134. The lounge seat portions are preferably rigidly affixed to form a fully rigid lounge seat where no parts of lounge seat 130 are moveable as shown in FIG. 1A.

FIG. 1A shows seat support 120 preferably comprises an upper portion 122, a central portion 123, and a lower portion 124. Upper portion 122 is positioned above backrest portion 134 of lounge seat 130. Upper portion 122 is connected to central portion 123 which is connected to lower portion 124. Upper portion 122 of seat support 120 is pivotally suspended from support structure 102 about a single transverse pivot axis from pivot assembly 112 to provide the desired stable pendular movement when in motion. This single axis of movement provides a stable movement without the swaying or lateral movements that generally accompany a single point of contact for attaching other types of a seat support to a similar support structure that does not control the direction of movement of lounge seat 130 and limit undesired lateral movements. Preferably, all portions of seat support 120 form a single rigid structural member where lounge seat 130 is pivotally coupled to lower portion 124 of seat support 120. Further embodiments may provide for upper portion 122 and central portion 123 of seat support 120 to be rigidly attached forming a single structural member with central portion 123 and lower portion 124 of seat support 120 pivotally coupled so as to provide additional control over the desired reclination angle.

FIG. 1A further illustrates single lounge seat 130 moveably coupled to lower portion 124 of seat support 120 at horizontal cross bar 128 about a central axis axial joint 145. Lower portion 124 is preferably attached to an external sleeve component of crossbar 128.

Axial joint 145 is proximal to lounge seat 130 and rotatably attached to a frame member on lounge seat 130 as near to lounge seat 130 as reasonably and mechanically possible. Forward crossbar 128 is shown to rotatably support lounge seat 130.

Crossbar 128 may preferably be a hollow cylindrical sleeve, the exterior of which is rigidly connected to lower portion 124 rotating about a solid or hollow cylindrical internal axle or hinge pin for axial joint 145. Axial joint 145 may further be a single binge, double hinge, ball and socket joint, pin and bearings, a continuous axle or the like means of pivoting to create a central axis about which the lounge seat may rotate relative to seat support 120. The axle of axial joint 145 is rigidly affixed to a bracket portion of lounge seat 130. The bracket portion of lounge seat 130 is preferably attached to both seat portion 132 and back portion 134. Preferably and simply, axial joint 145 may comprise a solid or hollow rod, axle or bolt and bushing rotating inside of the hollow cylindrical sleeve of crossbar 128. This rotation may provide alternate reclination angles of lounge seat 130 for an occupant.

Figure 1B:
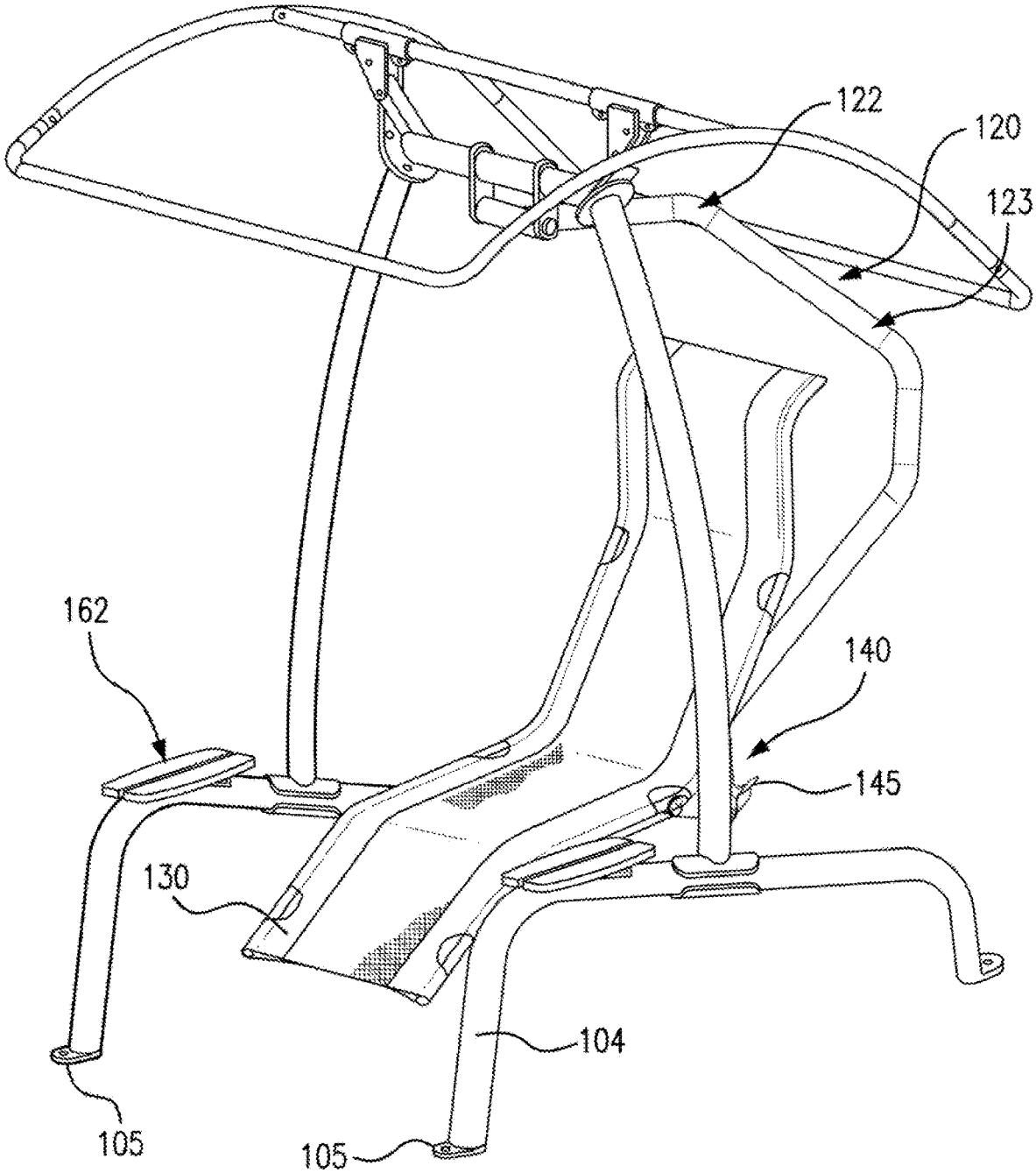
FIG. 1B is a perspective view of the embodiment of the single occupant swing constructed in accordance with the present invention illustrating a single lounge seat pivotally suspended by a single seat support and further illustrates the frame for an optional canopy.

FIG. 1B shows runners 104 attached to upright members 106. This configuration may be used for the fixed support structures of a variety of configurations of swings by simply substituting different top members. FIG. 1B further shows a canopy frame for a canopy may be added to fixed support structure 102 preferably attached to cooperating flanges of top member 110. Runners 104 are attached to the bottom end of upright members 106 of fixed support structure 102.

FIG. 1A and FIG. 1B show that swing 100 may also include a side table 162 attached to any appropriate portion of support structure 102 including to upright member 106 or to runner 104 as shown. Table 162 is designed for conveniently holding objects such as beverages and plates without being subjected to movement of lounge seat 130.

As illustrated throughout, adjustable lounge garden swing 100 does not have a lounge seat strap for securing an occupant in lounge seat 130 or device or strap for securing an occupant's feet, even for when lounge seat 130 is in a fully reclined, or about minus 30°, reclination angle position. The design of lounge seat 130 affords optimal comfort of an occupant without the need for any strap or securing device, even when lounge seat 130 is in motion.

FIG. 1B further illustrates that seat support 120 is positioned rear of the plane of the backrest portion 134 of a single lounge seat 130. In alternate configurations, seat support 120 may be a forked member positioned laterally to the right and to left side of single lounge seat 130.

Optional diagonal members may be connected between runners 104 and upright members 106 to provide added stability. Runners 104 may have optional feet 105 at each end thereof for resting on a ground surface. Feet 105 may be provided with holes throughout so that swing 100 may be secured to a supporting surface with bolts.

The structural members of support structure 102 are preferably fabricated of tubular steel or aluminum. Other materials, including wood, plastics or composite materials such as fiberglass, may also be used. The structural members may be assembled with mechanical fasteners, with welded joints or a combination of the two. The use of mechanical fasteners to join major assemblies of the structural components allows for a more compact shipping configuration. Components of support structure 102 may be hollow or solid as desired and cylindrical, square or other geometric crosssection desired to provide the necessary stability and structural integrity to withstand and support the pendular movement of lounge seat 130.

Pivot assembly 112 may optionally rotate about the transverse axis of pivot assembly 112 to provide the option of reversibly rotating seat support 120 in a 180° rotation relative to support structure 102 in order to reverse the forward-facing direction of lounge seat 130. This allows seat support 120 and attached lounge seat 130 to be reversibly rotated relative to support structure 102 from a forward position to a reverse position. This may be accomplished by a swivel mechanism that may be locked into either a forward facing or rear facing position.

Pivot assembly 112 may provide other features to further modify the pendular movement of seat support 120 when in motion such as spring stops to prevent an over swing initiated by an occupant or bystander going beyond the designed swing arc of the present invention. A spring or other cushioning type of stop positioned at the ends of the designed pendular swing movement may provide a smooth stop at the ends of the swing movement rather than a solid bumper type stop or no stop at all.

Lounge seat 130 is in a horizontal or near a zero gravity position when lounge seat 130, or lounge seat 130 and an occupant, have their center of gravity over axial joint 145 center axis. When lounge seat 130 is in a near horizontal position it is preferably at a reclination angle of 0° as referenced relative to the ground surface upon which lounge swing 100 is presented. Lounge seat 130 is adjustable from this near horizontal position to a maximum forward position with a reclination angle of about plus 30° to a maximum reverse position with a reclination angle of about minus 30°. More preferably the reclination angle is adjustable from about plus 20° to about minus 30° while providing a soothing pendular motion. Typically, when the lounge seat is in horizontal position to a minus position, the legs are elevated such that the legs are even with or above the occupant's heart.

Reclination adjustor 140 preferably releasably couples lounge seat 130 and seat support 120. In an alternative configuration, a reclination adjustor 140 may releasably couple and pivot central portion 123 and lower portion 124 of seat support 120, and lounge seat 130, by an axial joint providing a similar range of motion for various reclination angles. In this alternative configuration, lounge seat 130 and lower portion 124 of seat support 120 are rigidly attached.

Lounge seat 130 may be constructed of a plurality of pieces of wood, metal, fabric or a plastic material. Alternatively, seating portion 132 and backrest portion 134 may each comprise a single molded component, which may include cushioning if desired. Such components may be upholstered with suitable materials, such as cloth, leather or imitation leather. Seat portion 132 and backrest portion 134 may also be constructed using other materials that are commonly used for lawn furniture, such as nylon mesh, vinyl strapping, etc. Whatever materials are used for seating portion 132 and backrest portion 134, head rest 138 is preferably cushioned for an occupant's comfort. Head rest 138 may be constructed with polyurethane or other suitable material in the manner commonly used for padded components of exercise equipment.

Figure 2:
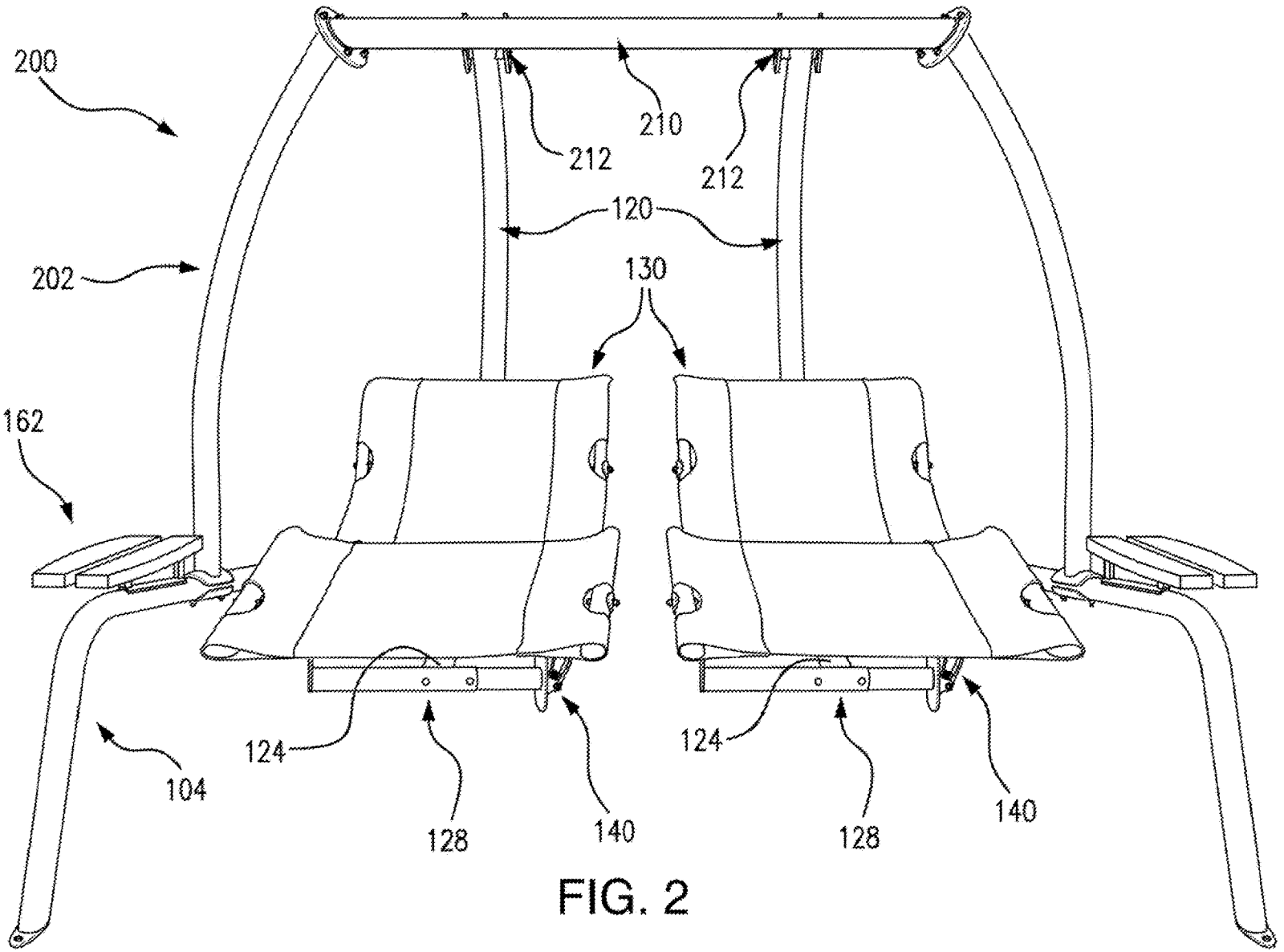
FIG. 2 is a front view of an embodiment of a swing constructed in accordance with the present invention illustrating two lounge seats pivotally suspended independently by two separate pivot assemblies that allow each lounge seat to swing independently relative to the support structure.

FIG. 2 illustrates lounge swing 200 shown similar to lounge swing 100, but with space for two occupants by using two individual and independently moveable lounge seats 130, each moveably attached to an independent seat support 120, each seat support 120 being pivotally attached to top member 210 through pivot assembly 212 allowing for independent swinging movement of each lounge seat 130. The two lounge seats 130 are similar in that they are mirror images of the other. Preferably, reclination adjustor 140 is positioned on the outside of each lounge seat 130. The left lounge seat 130 is on the left side of lounge swing 200 as an occupant would be sitting in the lounge seat 130 and the right lounge seat 130 is on the right side of lounge swing 200 as an occupant would be sitting in lounge seat 130. As such, reclination adjustor 140 is on the left side of left lounge seat 130 and on the right side of right lounge seat 130. Fixed support structure 202 may be similar to support structure 102 and utilize similar runners 104 and upright members 106 as in the previously described embodiment. Top member 210 may be a lengthened top member 110 to provide the additional width necessary to accommodate the two lounge seats 130.

Figure 3:
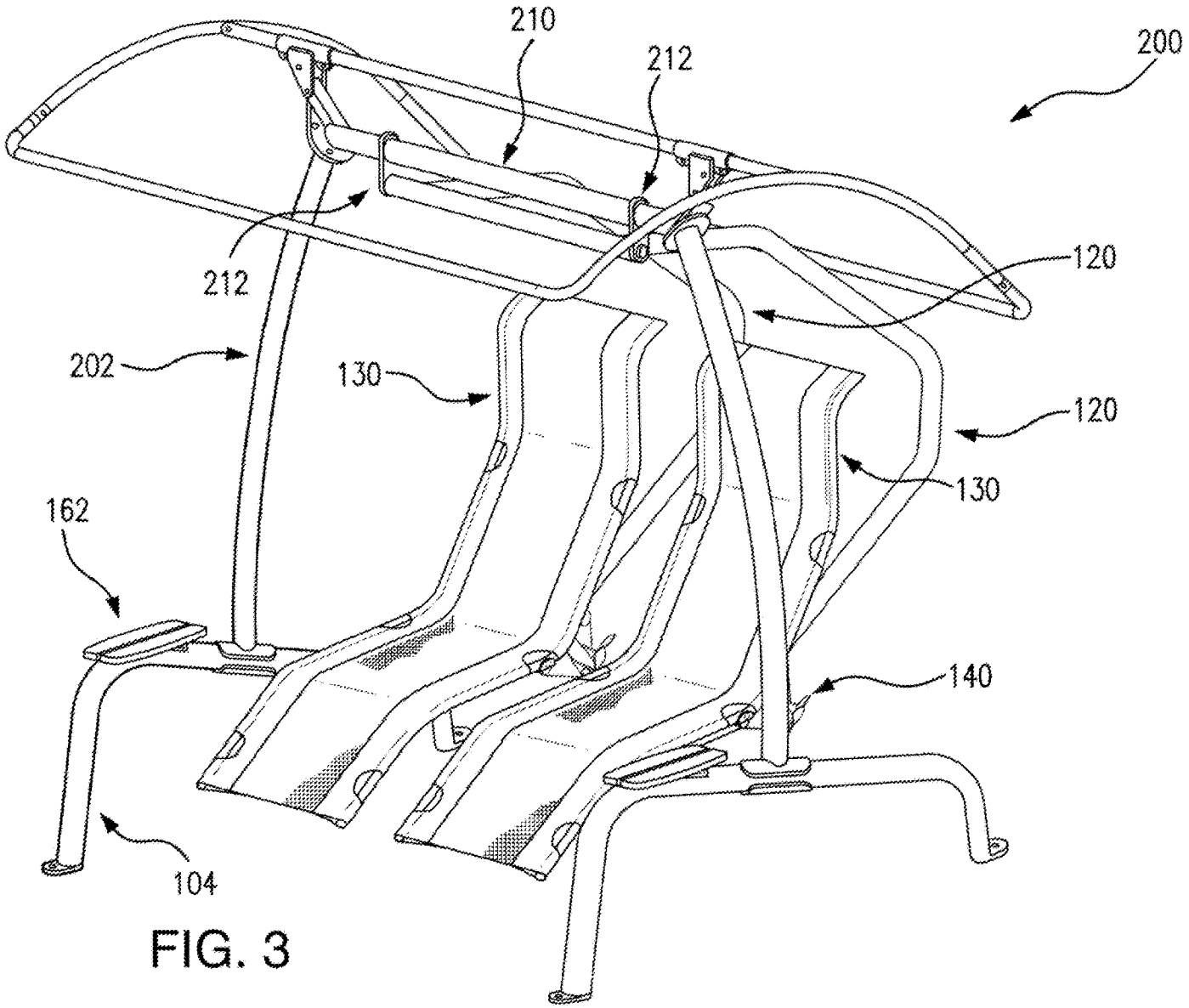
FIG. 3 is a perspective view of an alternate configuration of an embodiment for a two lounge seat swing constructed in accordance with the present invention illustrating two lounge seats pivotally suspended by a single pivot assembly such that the lounge seats will swing together.

FIG. 3 shows an alternate configuration of an embodiment of the present invention where two lounge seats 130 may be moveably coupled to a single support 212 that provides a unified seat arrangement for the two occupants. The two lounge seats 130 may be separate units or they could be coupled to form a single bench-type seating portion designed and capable of holding two occupants. In this embodiment, the single seating portion may be common to both of the lounge seats 130, while the backrest portions 134, together with the head rests 138 may remain individual and separate. However, it will be recognized that individual lounge seats 130 and seating portions identical to seating portion 132 could be provided instead.

Where two separate lounge seats 130 are suspended as shown in FIG. 3, seat support 120 from each lounge seat 130 may suspended from a single pivot assembly 212. In this regard, a single support 120 may attach both lounge seats 130 to pivot assembly 212 where seat support 120 is such that central portion 123 is configured into a fork to extend from a single upper portion 122 to two separate lower portions 124 movably attaching to each lounge seat 130, but lounge seats 130 are otherwise similar.

FIG. 3 further shows an optional canopy frame for a canopy that may be added to fixed support structure 202 and attached to cooperating flanges of top member 210.

FIG. 2 and FIG. 3 each illustrate the two person independent swing lounge seats 130 where each lounge seat 130 is preferably pivotally coupled to lower portion 124 of seat support 120 by crossbar 128 with resulting rotation possible about a center axis of axial joint 145. This allows each lounge seat 130, in either configuration to independently adjust its reclination angle by its own reclination adjustor 140. Regardless of whether lounge seats 130 are swinging together or independently, they each may independently adjust their reclination angle with their separate reclination adjustor 140.

Figure 4:
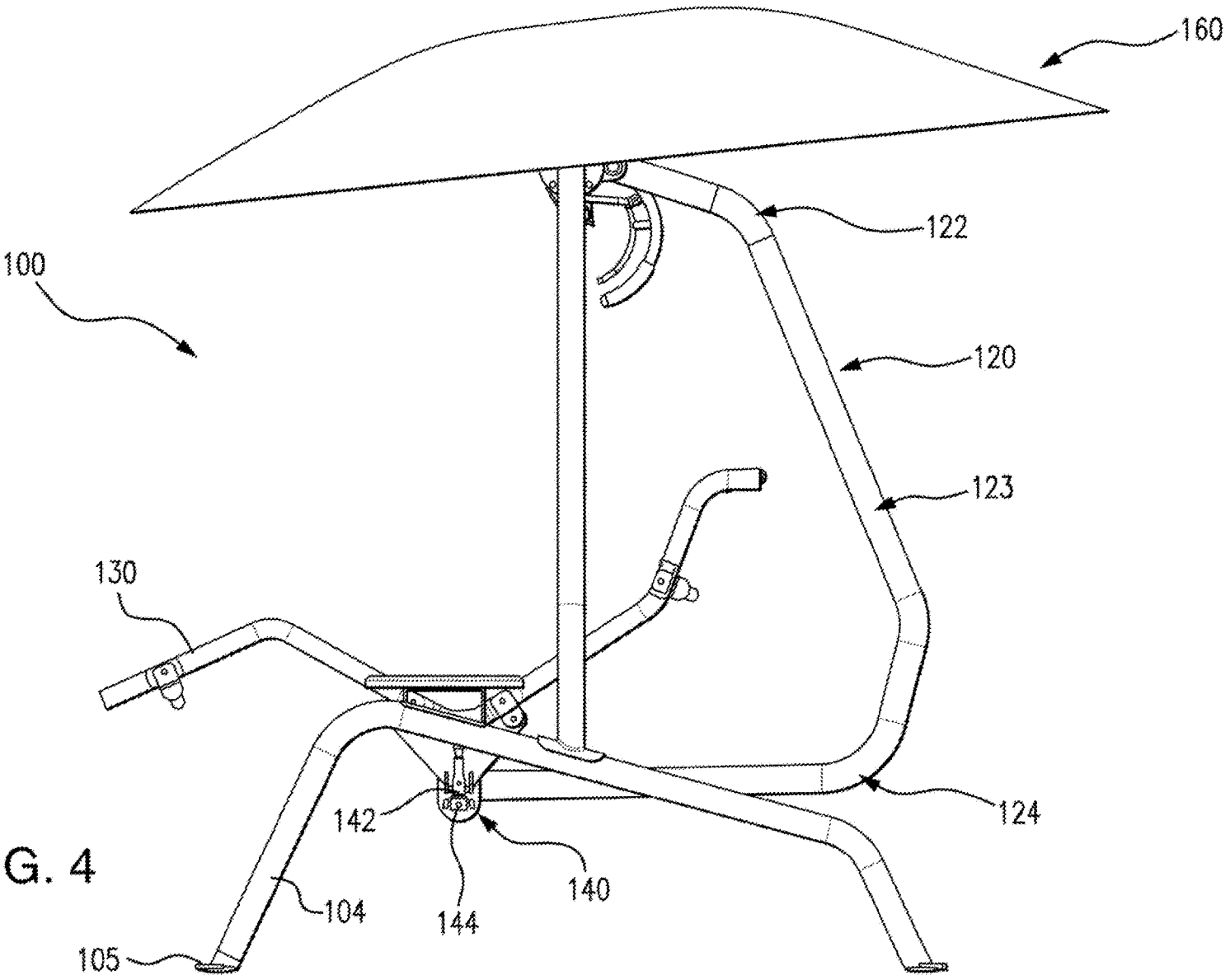
FIG. 4 is a left side view of the single occupant swing shown in FIG. 1A, illustrating the reclination adjustor assembly constructed in accordance with the present invention.

FIG. 4 is a left side view of a single occupant swing constructed in accordance with the present invention as shown in FIG. 1A. FIG. 4 also illustrates that swing 100 may include optional canopy 160 mostly covering lounge seat 130. Canopy 160 may have any appropriate frame attached to support structure 102 for holding canopy 160. In particular, canopy 160 may be attached by a frame to top member 110 to support canopy 160. Canopy 160 may be constructed of any various outdoor appropriate materials such as canvas or another suitable material. Canopy 160 and canopy frame may pivotally rotate forward or rearward as desired by an occupant.

An alternate embodiment of the present invention may be where seat portion 132 of lounge seat 130 and backrest portion 134 are rigidly affixed with leg rest portion 136 moveably affixed to seat portion 132 to form a partially rigid lounge seat 130. The left side view illustration of lounge seat 130 in FIG. 4 shows an optional adjustment device where this movable connection may be located along the linear portion of leg rest portion 136 or at the connection between leg rest portion 136 and seat portion 132. With a partially rigid lounge seat 130, leg rest portion 136 may rotate relative to seat portion 132 in order to accommodate occupants with longer or shorter legs or to adjust the comfort to the occupant's desire.

Similarly, and for similar reasons, an optional adjustment device may be located along the linear portion of back rest portion 134 or at the connection between back rest portion 134 and head rest portion 138.

Support structure 102 and seat support 120 may be dimensioned so that an occupant of lounge seat 130, with leg rest portion 136, if moveable, can comfortably rest his or her feet on the ground. This permits easy ingress to and egress from lounge seat 130 and also allows an occupant to easily propel lounge seat 130 of swing 100 in a pendular motion using his or her feet against the ground.

Lounge seat 130 is pivotally attached by axial joint 145 to lower portion 124 of seat support 120 proximal the center of gravity of lounge seat 130. It is preferred that axial joint 145 be located proximal to lounge seat 130 and preferably as close to the center of gravity of lounge seat 130 as mechanically possible. This location of axial joint 145 aids an occupant when adjusting the reclination angle of the lounge seat by keeping the center of gravity as near axial joint 145 as possible. In this manner, when reclination adjustor 140 is disengaged, them is less likelihood of lounge seat 130 abruptly and uncontrollably rotating forward or back.

Figure 5:
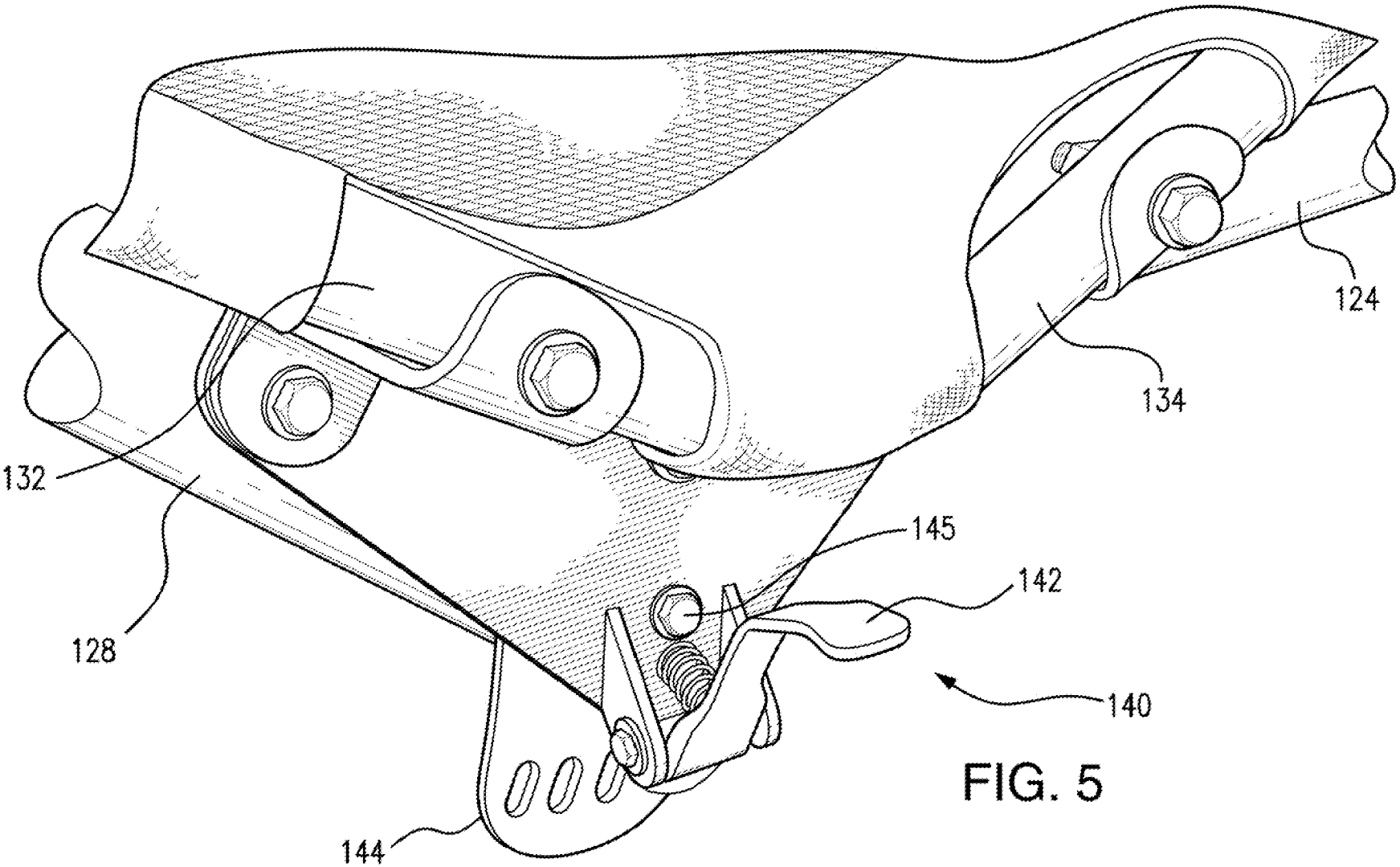
FIG. 5 is a detailed perspective view of a reclination adjustor for the present invention using an adjustor disc and spring loaded locking pin.

FIG. 5 illustrates a preferred embodiment of reclination adjustor 140 that is made of adjustor disc 144, spring loaded locking pin 142 and axial joint 145. Adjustor disc 144 of reclination adjustor 140 is preferably rigidly affixed to at least one end of the sleeve of crossbar 128 and spring loaded locking pin 142 has a frame member portion as shown that is attached to lounge seat 130. Axial joint 145 preferably comprises an axle or rod that is affixed to the frame member portion of locking pin 142 which is attached to lounge seat 130. Crossbar 128 is preferably a sleeve through which the axle or rod that is axial joint 145 goes through.

Preferably crossbar 128 is rotatably attached to lounge seat 130 proximal to the intersection of seat 132 and back 134, approximately the center of gravity for lounge seat 130. The end of lower portion 124 is rigidly affixed to the outside face of the sleeve of crossbar 128 with an internal axle of axial joint inside of the sleeve of crossbar 128. An end of the internal axle of axial joint 145 is in turn affixed to the frame member of locking pin 142 which is affixed to lounge seat 130. The exterior of external sleeve of crossbar 128 is affixed to the lower end of lower portion 124 and the external sleeve of crossbar 128 rotates freely about the internal axle of axial joint 145.

Movement of lounge seat 130 is preferably locked into place by releasable spring loaded locking pin 142.

In a preferred embodiment, a rear face of adjustor disc 144 is preferably affixed to the face of an end of the external sleeve of crossbar 128, which is affixed to seat support 120. Adjustor disc 144 shall have a hole or opening through which an end of the internal axle of axial joint 145 may penetrate and rotatably pass through such that the end of the internal axle of axial joint 145 is capable of attaching to the frame member or mounting bracket of spring loaded locking pin 142. Such a preferred arrangement allows adjustor disc 144 to rotate about the internal axle of axial joint 145 and in turn allow spring loaded locking pin 142 select any desired adjustor hole in adjustor disc 144. Adjustor disc 144 shall have a plurality of adjustor holes for accepting the pin of spring loaded locking pin 142 to lock and stop the rotational movement of lounge seat 130 at a desired reclination angle. Axial joint 145 in the present embodiment includes an axle, rod or bolt within the sleeve of crossbar 128 to provide durability and ease of motion. The axle, rod or bolt of axial joint 145 extends through adjustor disc 144 and rigidly attaches to the frame member or mounting bracket of releasable spring loaded locking pin 142. The frame member or mounting bracket of releasable spring loaded locking pin 142 being rigidly affixed to lounge seat 130.

Reclination adjustor 140 is preferably located proximal axial joint 145 and accessible by an occupant of lounge seat 130 on the right side or the left side of lounge seat 130 to releasably affix and lock lounge seat 130 into a particular reclination angle about the central axis of axial joint 145 relative to seat support 120.

Reclination adjustor 140 is preferably designed and manufactured such that during assembly, it can be installed on either the left or the right side of lounge seat 130. More preferably, reclination adjustor 140 is preferably symmetrical in that there is the same number of holes in the adjustor disc 144 for reclining back as sitting forward to further allow ease of assembly of reclination adjustor 140 to either the left or the right side of lounge seat 130.

FIG. 5 also illustrates that releasable spring loaded locking pin 142 is preferably a spring-loaded releasable locking pin assembly. A locking pin is attached to a face at one end of a lever arm. On the opposite end of the lever arm and on the same face is located a spring in contact between the face of the lever arm and the outside face of the frame member or mounting bracket of locking pin assembly 142. The inside face of the frame member or mounting bracket of locking pin assembly 142 is in movable contact with adjustor disc 144. The lever arm toggles about a fulcrum attachment on the same face of the frame member or mounting bracket of locking pin 142, the spring of which places the locking pin in a default penetrating mode capable of penetrating a desired hole in adjustor disc 144 created by pressure of the spring.

Releasable spring loaded locking pin 142 assembly is affixed to lounge seat 130 by its frame member or mounting bracket. When the spring end of the lever arm of locking pin assembly 142 is depressed, the locking pin is removed from a hole in adjustor disc 144 allowing lounge seat 130 to rotate about axial joint 145 and move forward or back to the desired position. When the spring end of the lever arm of locking pin assembly 142 is then released, the locking pin is reinserted into a desired hole in adjustor disc 144 and locked into position to allow an occupant to enter lounge seat 130.

From the horizontal position, lounge seat 130 may recline throughout a range of motion of about 30° forward, or plus 30°, to about 30° backwards, or minus 30°. Preferably, the range of motion is from about plus 30° to about minus 10° degrees for preferred comfort. Positive 30° provides a near vertical backrest portion 134 of lounge seat 130 to approximate a more upright chair position. The negative angles provide an approximate anti-gravity position where the occupant's legs are higher than its heart.

Reclination adjustor 140 may be of other various adjustment mechanisms. An alternate embodiment of reclination adjustor 140 may be a friction disc knob and sliding channel. Similar to adjustor disc 144 and spring loaded locking pin 142, each member may be mounted to lounge seat 130 or seat support 120 or axial joint 145 as designed. A friction disc knob and sliding channel reclination adjustor may be slidably coupled to the respective seat support 120 at a point located vertically higher than a lower surface of seat portion 132 and may be coupled to seat portion 132 of lounge seat 130. A locking control mechanism may be connected to each locking member at the slidable connection and actuatable to immobilize the slidable connection so as to lock lounge seat 130 in a desired position relative to the seat support.

In any such embodiment, when reclination adjustor 140 is coupled between lounge seat 130 and seat support 120 or between lounge seat 130 and axial joint 145, it can more particularly be located between seat portion 132 of lounge seat 130 and axial joint 145 or seat support 130, or between backrest portion 134 and seat support 120, depending upon the particular configuration of lounge seat 130 design. In either configuration, axial joint 145 is preferably located such that it substantially maintains the center of gravity of lounge seat 130 over axial joint 145. A fully rigid or partially rigid lounge seat 130 may be rotated about the central axis of axial joint 145 and locked into place by reclination adjuster 140.

When reclination adjustor 140 couples lounge seat 130 and seat support 120 about axial joint 145, spring loaded locking pin assembly 142 is preferably affixed to lounge seat 130 and to the axle, rod or bolt of axial joint 145. An inside face of adjustor disc 144 is preferably affixed to at least one end of the external sleeve of crossbar 128, the exterior face of which is rigidly attached to a lower end of the lower portion 124 of seat support 120. Alternatively, the inside face of the frame member of spring loaded locking pin assembly 142 may be affixed to the end of the external sleeve of crossbar 128 which may be rigidly attached to a lower end of the lower portion 124 of seat support 120 in which case adjustor disc 144 would be affixed to lounge seat 130 and the axle, rod or bolt of axial joint 145.

In order to provide for smooth adjustment of lounge seat 130 about the central axis of axial joint 145, any other common elements may be added such as counter-springs, hydraulic shock absorbers, or the like, to prevent an abrupt falling of lounge seat 130 when the locking pin of spring loaded locking pin assembly 142 is disengaged, removed from a hole in adjustor disc 144, and an occupant is changing the reclination angle. Similarly, hydraulic or electrical adjustment assistance may be provided to automatically adjust the lounge seat into a desired position without mechanical assistance by an occupant.

will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

The above detailed description of exemplary embodiments of the invention is provided to illustrate the various aspects of the invention, and is not intended to limit the scope of the invention thereto. Persons of ordinary skill in the art will recognize that certain modifications can be made to the described embodiments without departing from the invention. All such modifications are intended to be within the scope of the appended claims.

The invention claimed is:

1. An adjustable lounge garden swing comprising;

a support structure that comprises a horizontal top portion having a first end and a second end that is opposite to the first end, wherein the horizontal top portion is supported by a first upright portion and a second upright portion fixedly supporting the first end and second end, respectively;

a seat support having an upper portion that is pivotally suspended from the horizontal top portion of the support structure on a pivot axis;

a lounge seat pivotally coupled to a lower portion of the seat support; and a reclination adjustor that couples the lounge seat to the lower portion, and wherein the reclination adjustor is operable to lock the lounge seat relative to the lower portion.

2. The adjustable lounge garden swing of claim 1 wherein the pivot axis provides a pendular movement of the seat support relative to the support structure when in motion.

3. The adjustable lounge garden swing of claim 1 wherein the lounge seat is pivotally coupled to the lower portion of the seat support by a pivot joint.

4. The adjustable lounge garden swing of claim 1 wherein the reclination adjustor releasably controls a pivot angle of the lounge seat relative to the seat support.

5. The adjustable lounge garden swing of claim 4 wherein the reclination adjustor releasably affixes the pivot angle between the lounge seat and the seat support between +10° and −10°.

6. The adjustable lounge garden swing of claim 1 wherein the reclination adjustor comprises a spring loaded locking pin and an adjustor disc.

7. The adjustable lounge garden swing of claim 6 wherein the adjustor disc has a plurality of holes for accepting the spring loaded locking pin.

8. The adjustable lounge garden swing of claim 6 wherein the spring loaded locking pin is affixed to the lounge seat and the adjustor disc is affixed to the lower portion of the seat support.

9. The adjustable lounge garden, swing of claim 1 wherein the lounge seat is movable about a pivot joint and locked into place by the reclination adjustor.

10. The adjustable lounge garden swing of claim 1, wherein the adjustable lounge garden swing comprises two lounge seats, each lounge seat is pivotally coupled to a separate seat support, each separate seat support suspended from the horizontal top portion of the support structure on the pivot axis, such that each separate seat support is configured to pivot about the pivot axis independent from one another.

11. The adjustable lounge garden swing of claim 1 further comprising a side table that is coupled to a portion of the support structure.

12. The adjustable lounge garden swing of claim 1 further comprising a pivotally adjustable canopy that is coupled to a top portion of the support structure and at least partially covers the lounge seat.

13. An adjustable lounge swing comprising:

a support structure;

a seat support pivotally suspended from the support structure on a pivot axis;

a lounge seat pivotally coupled to a lower portion of the seat support, wherein the lounge seat comprises a backrest portion, a seat portion and a leg rest portion, wherein the seat portion and the backrest portion is pivotally coupled to the lower portion of the seat support about a center axis by a pivot joint that is proximate to and below a transition between the seat portion and the backrest portion of the lounge seat; and a reclination adjustor coupled between the lounge seat and the lower portion of the seat support, and wherein the reclination adjustor is operable to lock the lounge seat in a reclined position.

14. The adjustable lounge swing of claim 13 wherein the pivot axis provides a pendular movement of the seat support relative to the support structure when in motion.

15. The adjustable lounge swing of claim 13 wherein the reclination adjustor releasably controls a pivot angle of the lounge seat relative to the seat support.

16. The adjustable lounge swing of claim 15 wherein the reclination adjustor releasably affixes the pivot angle between the lounge seat and the seat support between +10° and −10°.

17. The adjustable lounge swing of claim 13 wherein the adjustable lounge garden swing comprises two lounge seats, each lounge seat is pivotally coupled to a separate seat support, each separate seat support suspended from the support structure on the pivot axis, such that each separate seat support is configured to pivot about the pivot axis independent from one another.

18. The adjustable lounge swing of claim 13 further comprising a side table that is coupled to a portion of the support structure.

19. The adjustable lounge swing of claim 13 further comprising a pivotally adjustable canopy that is coupled to a top portion of the support structure and at least partially covers the lounge seat.

20. An adjustable lounge swing comprising:

a support structure;

a seat support pivotally suspended from the support structure on a pivot axis;

a lounge seat pivotally coupled to a lower portion of the seat support, wherein the lounge seat comprises a backrest portion, a seat portion and a leg rest portion, wherein the seat portion and the backrest portion is pivotally coupled to the lower portion of the seat support about an axis by a pivot joint that is proximate to and below a transition between the seat portion and the backrest portion of the lounge seat; and a reclination adjustor coupled to 1) the backrest portion and the seat portion and 2) the pivot joint, wherein the reclination adjustor is operable to adjust and lock a position of the backrest portion or the seat portion relative to the seat support.

21. The adjustable lounge swing of claim 20 wherein the reclination adjustor comprises a spring loaded locking pin and an adjustor disc, and the adjustor disc has a hole for accepting the spring loaded locking pin.

22. The adjustable lounge swing of claim 20 wherein the reclination adjustor is accessible for manual adjustment by an occupant of the lounge seat.

23. The adjustable lounge swing of claim 20 wherein the reclination adjustor locks the lounge seat in a reclined position.

24. The adjustable lounge swing of claim 20 wherein the adjustable lounge garden swing comprises two lounge seats, each lounge seat is pivotally coupled to a separate seat support, each separate seat support suspended from the support structure on the pivot axis, such that each separate seat support is configured to pivot about the pivot axis independent from one another.

25. The adjustable lounge swing of claim 20 further comprising a side table that is coupled to a portion of the support structure.

26. The adjustable lounge swing of claim 20 further comprising a pivotally adjustable canopy that is coupled to a top portion of the support structure and at least partially covers the lounge seat.

* * * * *